United States Patent [19]

Coyle et al.

[11] Patent Number: 4,606,648

[45] Date of Patent: Aug. 19, 1986

[54] CLUSTERED MIXING SYSTEM

[75] Inventors: Chandler K. Coyle, Pittsford; Ronald N. Salzman, Rochester, both of N.Y.

[73] Assignee: General Signal Corporation, Stamford, Conn.

[21] Appl. No.: 636,329

[22] Filed: Jul. 31, 1984

[51] Int. Cl.[4] ..... B01F 7/22

[52] U.S. Cl. ..... 366/300; 366/297

[58] Field of Search ..... 366/297–301, 366/601, 279, 342, 343, 198; 68/124, 184

[56] References Cited

U.S. PATENT DOCUMENTS

| | | | |
|---|---|---|---|
| 1,769,221 | 7/1930 | Howcott . | |
| 2,180,148 | 11/1939 | Imhoff | 366/300 X |
| 3,154,601 | 10/1964 | Kalinske et al. | 366/297 X |
| 3,323,782 | 6/1967 | Clough | 366/297 X |
| 3,342,459 | 9/1967 | Myers et al. . | |
| 3,356,347 | 12/1967 | Boschen . | |
| 3,356,348 | 12/1967 | Paul, Jr. . | |
| 4,091,463 | 5/1978 | Tschudy et al. . | |

*Primary Examiner*—Timothy F. Simone

*Attorney, Agent, or Firm*—Barnes & Thornburg

[57] ABSTRACT

At least two levels of mixing, one adjacent the top of the vessel and one adjacent the bottom of the vessel are provided and individually driven at appropriate speeds to produce a single flow pattern in the fluid in the vessel. The bottom mixing apparatus is preferably a single large diameter impeller whereas the top mixing apparatus includes a plurality of smaller diameter impellers positioned equally distant from and symmetrical about the lower impeller's vertical axis of rotation. Each of the impellers have a converging flow field exiting the impeller.

27 Claims, 7 Drawing Figures

CLUSTERED MIXING SYSTEM

BACKGROUND AND SUMMARY OF THE INVENTION

The present invention relates generally to mixing apparatus and more particularly to an apparatus for mixing liquids with liquids, liquids with solids and liquids with gases contained in a vessel. As used in this application, the term "fluid" includes, but is not limited to, all of the above.

Mixing of liquids or liquid suspensions in a vessel generally requires an impeller on the end of a shaft being driven to create flow fields in the fluid in the vessel. The mixing apparatus is designed to achieve a desired degree of mixing of the liquids, solids or gases in the liquid. Depending upon the depth of the tank, the viscosity of the liquids and the type of impeller, one or more impellers may have to be used. The use of multiple impellers on a single shaft is well known in the prior art to accomodate vessels of increased depth and high viscosity material. In order to produce a single flow field, pitch blade turbine must be closely spaced, for example, within ½ to ¾ the blade diameter apart. Otherwise, substantially independent plural flow fields and thus levels or vertical zones of mixing results as illustrated in FIG. 1. Since the rotational speed of the shaft is the same for all impellers on a single shaft, the power cannot be independently adjusted for each level of the liquid. This restricts the ability to perform certain chemical processes which require different power requirements at different levels at different times in the process.

The prior art has attempted to provide concentric drive shafts to allow individual speed control of coaxial impellers. The disadvantages of this system is that the gear drive and shaft for the upper-outer mixer are very expensive. Also, the bore through the reducer and shaft must be sufficiently large to allow the lower shaft to pass through and also leave room for shaft deflection.

Certain applications require different degrees of mixing at different periods. For example, in a solid suspension, the uniformity of suspension is desired during dispensing while a low degree of suspension short of complete settling is desired during periods between dispensing. Variable speed drivers have been used, but have not been satisfactory. Since power is a function of the cube of speed, it is difficult to adjust the speed to obtain the desired power. Prior art systems are generally designed for a single mode of operation, for example, uniform mixing or suspension. In a start-up situation where a lower mixer may be encased in sediment, various solutions have been attempted. One solution is to raise the lower mixer above the sediment before activating. This requires an extensive support and lifting system. Alternatively, others have maintained mixing which is an inefficient use of energy.

As used in this application, a "single flow pattern" is where for each vertical plane originating and extending radially from the center axis of a cluster of mixers, there is only one null point. A null point is where the mean velocity is zero and the flow in the vertical plane circulates about this point. The locus of null points formed by all such vertical planes is a single closed loop. The flow pattern can thus be described as a toroid about the single closed loop. Obviously, this excludes small secondary flow patterns around baffles, corners, and other localized disruptions in the mixing vessel. If there is total symmetry; if the secondary mixers rotate in a direction that is opposite the direction of rotation of the first mixer; if the mixing vessel is cylindrical; and if no baffles are used, then the closed loop will be a circle.

Thus, it is an object of the present invention to provide a multiple impeller system which generates a single flow pattern and affords maximum operating flexibility.

Another object of the present invention is to provide an impeller system design for relatively deep tanks to provide substantially axial flow through mixers thus developing an efficient top to bottom mixing pattern.

A further object of the present invention is to provide a mixing apparatus which is energy efficient by being able to maintain flow without maintaining homogeneity in the fluid.

Still a further object of the present invention is to provide a mixing system having the ability to efficiently and economically produce different degrees of mixing at different times in an operating cycle.

An even further object of the present invention is to provide a mixing system capable of generating a single flow pattern even with some impeller failures.

A still even further object of the present invention is to provide a multi-level impeller system which is energy efficient in all modes of operation.

Even a further object of the present invention is to provide a mixing system which eliminates the need for vertical baffles.

These and other objects of the invention are attained by providing at least two levels of mixing, one adajcent the top of the vessel and one adjacent the bottom of the vessel and individually driven at appropriate speeds to produce a single flow pattern in the liquid in the vessel. The pumping of each level is designed for the desired degree of mixing at that level while maintaining the single flow pattern. The bottom mixing apparatus is preferably a single large diameter impeller whereas the top mixing apparatus includes a plurality of smaller diameter impellers. The plurality of upper level mixers are positioned equally distant from and symmetrical about the lower impeller's vertical axis of rotation. Each of the impellers have a substantial axial or converging flow field exiting the impeller. For vessels of even greater depth and for other systems or processes requiring more levels of mixing, an additional plurality of impellers may be provided between the top plurality and the bottom single impeller driven so as to produce a single flow field with appropriate pumping at each level of mixing. As an alternative, the plurality of impellers may be substantially spaced from the single impeller and operated to produce pumped flow in the opposite direction of the single impeller; producing the single flow pattern.

Vertical baffles can be eliminated by chosing the impellers that rotate in opposite directions while developing a single flow pattern in the vessel.

A controller activates and deactivates the individual impellers to achieve the desired degrees of mixing at different times or stages of a process. For impeller failures, the controller may deactivate other impellers to maintain the single flow pattern. The side and bottom of the tank meet at the interior of the tank at an angle greater than 90° C. to improve flow efficiency.

The use of a plurality of vertical rotational axis mixers with plural impellers on each drive shaft is well known in the prior art. These are generally interleaved so as to provide high shear force to blend very viscous materials. These are high shear systems with independent interweaving flow patterns not designed for efficient pumping. Similarly, the use of a large slow moving mixer to produce the gross flow of material and a smaller diameter, high speed mixer to produce high shear forces and no pumping adjacent thereto is also known in the prior art. This configuration is considered a single level of mixing. Generally high shear, small diameter mixers produces amalgamation or breaking action at the edge of the flow control mixer to introduce granular material into the overall mixture. Again, this is generally for fluids of high viscosity. The prior art also includes a plurality of horizontally spaced mixers each having separate and independent mixing zones. Although multiple mixers at various depths and locations in a container are known for many purposes, the concept of using plural mixers at different levels or locations to produce a single flow pattern is not shown by the prior art.

Other objects, advantages and novel features of the present invention will become apparent from the following detailed description of the invention when considered in conjunction with the accompanying drawings.

DETAILED DESCRIPTION OF THE DRAWINGS

Figure 2:
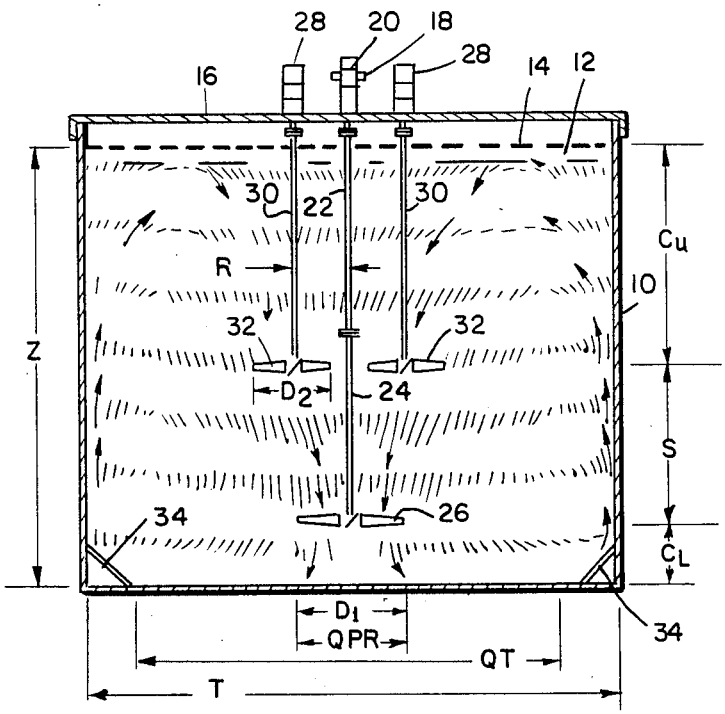
FIG. 2 is a side cutaway view of two levels of mixing incorporating the principles of the present invention taken along line II—II of FIG. 3.

The mixing apparatus of the present invention as illustrated in FIG. 2 is mounted in a tank 10 having a fluid 12 therein with a liquid level 14. The mixing apparatus includes a plurality of mixers mounted to support structures 16 and 18 as illustrated specifically in FIG. 2. The mixing system includes a first motor or drive means 20 connected by drive shafts 22 and 24 to an impeller 26 adjacent the bottom of the vessel 10. A plurality of second level mixing apparatus for example four are provided each including a motor or drive means 28 connected by shaft 30 to impeller 32. Although plural drive means or motors are illustrated, a single motor with appropriate gearing and clutches which allow individual control of the impellers may be used although not preferred. The impellers 32 are vertically displaced from the impeller 26 and rotate in a single plane. The plurality of impellers 32 form a cluster about the impeller 26 and are equally distant from the impeller 26 as well as from each other.

A fillet 34 is provided at the bottom of the tank 10 such that the bottom and side walls at the interior of the tank met at an angle greater than 90°. This removes the dead space at the intersection, reduces solid material build up in the intersection and improves the flow pattern at the intersection which allows energy reduction.

The diameter $D_1$ of impeller 26, the diameter $D_2$ of impellers 32, the speed $N_1$ and $N_2$ of the impellers 26 and 32, respectively, the distance $C_L$ of the impeller 26 from the bottom of the vessel, the distance $C_U$ of impeller 32 from the water level 14, the distance of vertical separation, S, of the impeller 26 and 32, the distance of horizontal separations, R, of the impeller 26 and 32, the number of impellers 32 in the cluster, are defined relative to the vessel diameter T and the height Z of the maximum fluid level 14 such as to produce a single flow pattern in the liquid.

Figure 3:
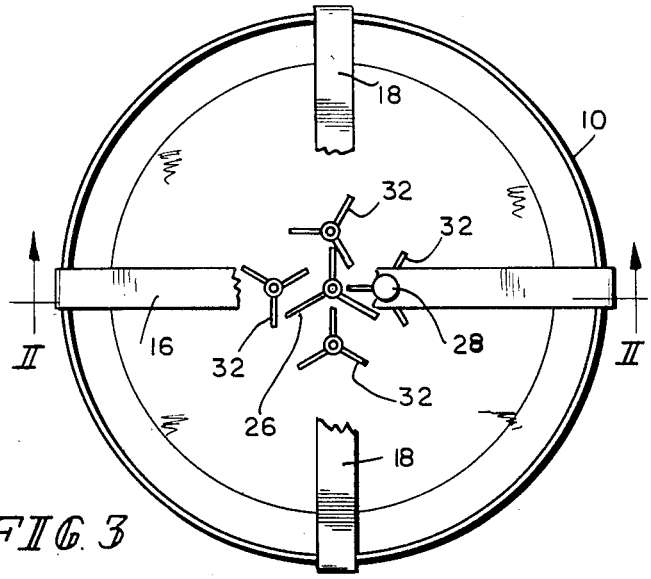
FIG. 3 is a top view of FIG. 2.

For a vessel having a ratio of maximum fluid level Z to the diameter of the vessel D in the range of 0.4 to 2, the two level mixing system of FIGS. 2 and 3 will produce a single flow pattern. The diameter $D_1$ of the lower impeller 26 should be in the range of 0.1 T to 0.5 T. The distance of separation $C_L$ of the lower impeller 26 from the bottom of the vessel should be in the range of 0.33 $D_1$ to 2.0 $D_1$. The upper impeller cluster 32 should be displaced from the fluid level 14 by a distance $C_U$ which is equal to or greater than 0.5 $D_2$. The distance of separation S between the lower impeller 26 and the cluster of upper impellers 32 should be in the range of 0.5 $D_1$ to 2.0 $D_1$. The distances R between the center line of impeller 26 and impellers 32 should be as close as possible without mechanical interference. Using the range of the variables just described, the speed and actual diameter as well as the number of impellers required to produce desired pumping in the upper and lower levels can be determined, to each fluid as a function of the fluid's characteristics.

The flow vectors of the single flow pattern in water are illustrated in FIG. 2 and were measured by a laser doppler velocimeter for the following structures:

| | |
|---|---|
| T = 48 inches | $D_1$ = 10 inches |
| Z = 38.4 inches | $D_2$ = 7 inches |
| $C_V$ = 19.2 inches | $N_1$ = 300 rpm |
| $C_S$ = 13.2 inches | $N_2$ = 392 rpm |
| $C_L$ = 6 inches | |

The operation of the present invention requires that the impellers 26 and 32 generate a predominently axial flow with little or minimal radial flow. This type of impeller has a converging flow field exiting the impeller. As illustrated in FIG. 2, the primary flow $Q_{PR}$ which is the flow passing through the impeller zone and the liquid actually pumped by the impeller is converging. The total flow $Q_T$ which includes induced flow through the tank and is measured from the center line to the null point produced by the impeller 26 includes converging and diverging regions. Such an impeller, the A310, is commercially available from Mixing Equipment Co., Inc., Rochester, N.Y.

By individually driving the different mixing units, the efficiency of the mixing, namely—the ratio of axial flow in gallons per minute Q to the energy in horse power P—may be maximized. Also, by using different levels of mixing under individual controls, a fluid flow may be maintained within the vessel which will not necessarily produce uniform mixing or a homogeneous mixture, but will keep the solids or particulate matter suspended in the liquid . Thus, during long term storage when uniformity of mixture or suspension is not critical, a smaller amount of energy is used to drive a limited number of the mixers. Thereby energy is conserved while avoiding eliminating start-up problems. If no circulation is maintained in liquid-solid mixtures, the particulate matter in the liquid would settle on the bottom and would have to be cleaned or the mixer system would have to be overdesigned with the capability of moving the sediment on the bottom at start-up to create the required suspension of the particulate matter in the liquids.

In liquid-liquid or liquid-gas mixtures, the liquid stratifies into layers of different consistencies. The interface of the stratified layers provides a flow barrier requiring substantial mixer power consumption and over design capability to overcome. Thus, the present system is designed to maintain sufficient flow, mixing or circulation to prevent formation of these interfaces.

Figure 5:
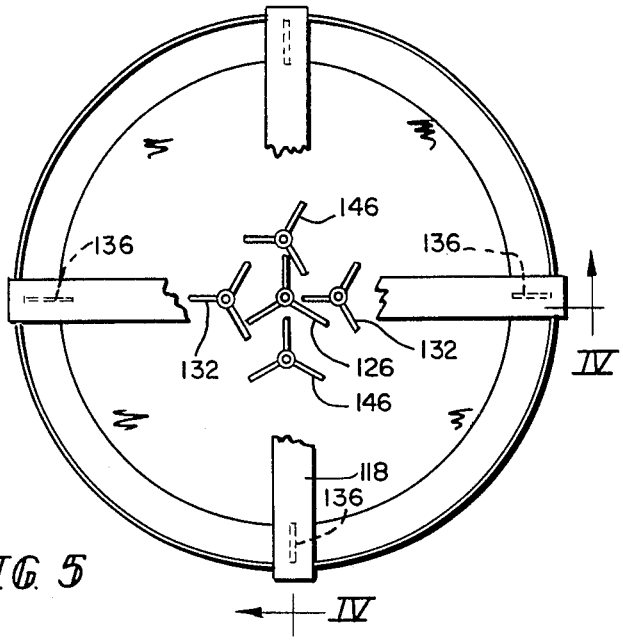
FIG. 5 is a top view of FIG. 4.
Figure 4:
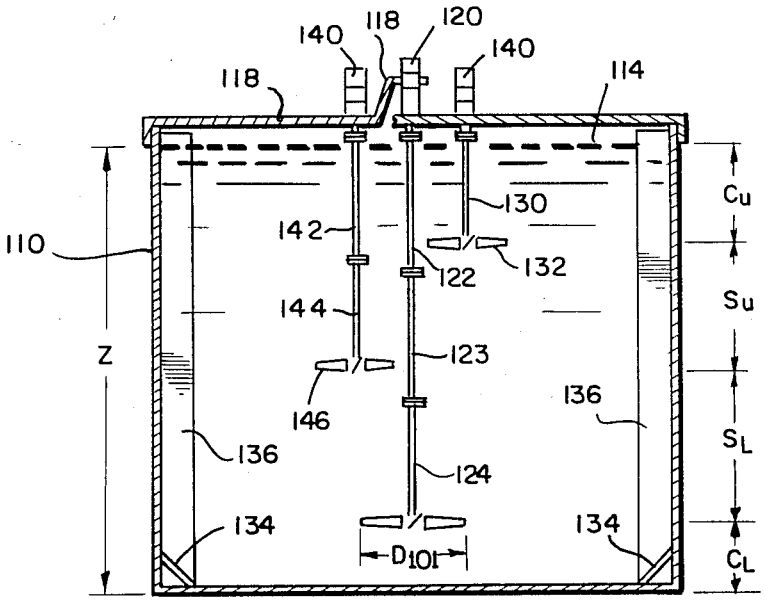
FIG. 4 is a side cutaway view of three levels of mixing incorporating the principles of the present invention taken along line IV—IV of FIG. 5.

For ratios of fluid level height to tank diameters of greater than two, multiple levels of mixing may be required. FIGS. 4 and 5 illustrate at least three levels of mixing. The common elements between FIGS. 2 and 3 and FIGS. 4 and 5 have similar numbers with the addition of the number 100 thereto. As illustrated in FIG. 4, the lower impeller 126 is connected to a motor 120 by shafts 122, 123 and 124. The upper cluster of mixers includes for each mixer an impeller 132 driven by motor 128 and connected by shaft 130. An intermediate level cluster of mixers includes for each mixer motor or drive means 140 connected by shafts 142 and 144 to an impeller 146.

Two of the four equally spaced baffles 136 are illustrated in FIG. 4, these baffles were deleted from FIG. 2 so as not to interfere with the illustration of the flow patterns. These baffles minimize any flow in a horizontal plane. The baffles may be eliminated from the embodiments in FIGS. 2 and 4 by proper selection of the mixers. For example, if the impellers 32 have the opposite hand (clockwise for example) from impeller 26 (counterclockwise) and are rotated in the opposite direction so as to pump in the same vertical direction, no baffles are needed. Thus, the cluster concept allows elimination of a further expense.

It is evident that as the depth of the tank is increased, the number of levels of mixer required may increase. Similarly, the number of impellers in each cluster at each level may be varied and that the illustration of two in the upper level and two in the intermediate levels are merely examples. Also, more levels of mixing are required for more viscous materials or requirements of specific chemical processes independent of vessel depth. In situations where the fluid level varies, significantly more levels of mixers are required to produce a single flow pattern for all fluid levels.

Figure 1:
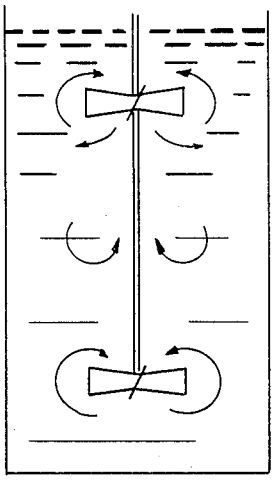
PRIOR ART FIG. 1
FIG. 1 is a side cutaway view of a pitch blade turbine system of the prior art.
Figure 6:
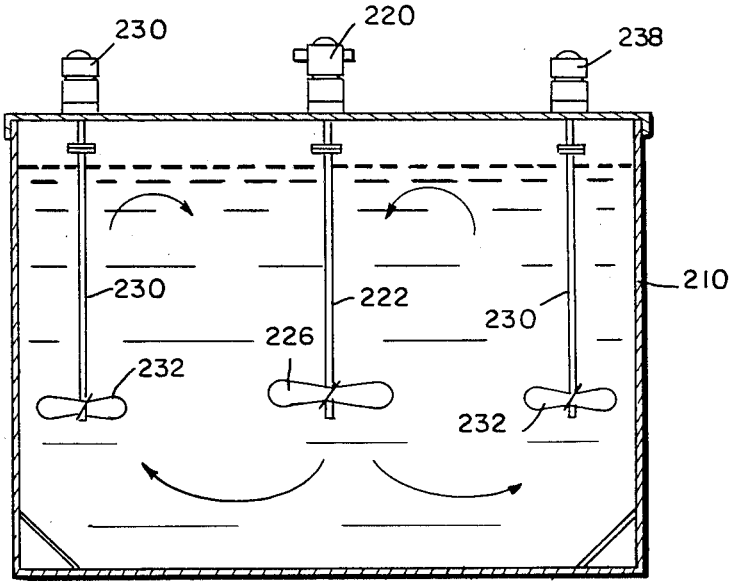
FIG. 6 is a side cutaway view of one level of mixing incorporating the principles of the present invention.

Another alternative as illustrated in FIG. 6 includes the cluster of mixers at the same level as the center mixer. The common elements between FIG. 2 and FIG. 6 has similar numbers with the addition of the number 200 thereto. The center impeller 226 is connected to motor 220 by shaft 222. The cluster of mixers includes for each mixer an impeller 232 driven by a motor 228 and connected by shaft 230. The impellers 232 have the same hand as impeller 226, but are mounted upside down and the motors 238 drive the impellers 232 in the opposite direction that motor 220 drives impeller 226 to pump in the opposite direction. This produces a cancellation of angular momentum and, thus, the baffles 136 are eliminated. This system, as the previous system, provides a single flow pattern. Although this is illustrated as an alternative, it is not a preferred embodiment since the cluster of impellers 232 must be operated at higher speeds to produce the desired flow patterns. Thus, this system embodiment is less energy efficient. Although impellers 232 are shown in the same plane as impeller 226, they may be in a common plane vertically displaced from the plane of impeller 226.

In most chemical processes, there are five modes of operation, namely—1. filling; 2. long-term storage; 3. start-up after prolonged shut-down; 4. uniform mix;; 5. pumping out. For a mixer system to be energy efficient, it must be energy efficient at all anticipated modes of operation. The present system produces this energy efficiency by selectively activating the appropriate level of mixing during the appropriate period or mode of operation. For example, during filling, the mixer at the appropriate level are activated in sequence as the vessel is filled. During long term storage, wherein the degree of consistency in the liquid may vary, the minimum number of impellers are activated to maintain a flow pattern at a low energy level which allows easier start-up and, thus, saves overall power. For start-ups after prolonged shut-down, the upper level of mixers may be activated to create a flow pattern which will agitate the settled particulates which may surround or impact the lower impellers. Once the other levels of impellers are free to rotate, they may be activated. This obviates the need for extensive mechanical mechanisms to lift the impacted impellers. For uniform mixing, all the impellers are operated at their designed speed to produce the single flow field. During pump-out, the uniform field is being maintained and the appropriate level of mixers are deactivated as the level of the liquid lowers. Thus, even with simple fixed speed motors, the cluster concept in combination with multi-levels of impellers produces a versatile system which is capable of accomodating various chemical processes while maintaining operating efficiency.

During long-term storage, which can be much longer than the period for filling and drawing off, the present system could be operated in the range of 40% of its designed horsepower to maintain the single unitary flow pattern. During uniform mix and draw-off, the system would be operated up to the designed horsepower. Depending on the hold time versus draw off time durations, the overall average power draw could be less than 50% of designed power. This is a substantial operation energy savings during the life of the equipment. In prior art systems having multiple impellers on a single shaft, the system could be operated at low speeds during the long-term storage. Because there is no way to maintain higher relative energy and flow at the lower impeller, the system would have to be periodically cycled to high power level during long term storage. By this way it is possible to maintain sufficient suspension of particulate matter to prevent impacting of the lower impeller. The prior art system, using an inefficient pitched blade turbine and a two speed motor, would oscillate between approximately 55% at a low speed to 130% at the design speed of the present system. Also since it is operated at the high speed or 130% of the present system, the amount of energy consumed during uniform mix and pump-out is substantially larger. Thus, it can be seen that the present system is capable of reducing the energy requirements by at least 50%.

It should be noted that the center impeller shafts 22, 122, or 222 may include a second impeller if desired in addition to the clustered impellers without departing from the spirit of the present invention.

Figure 7:
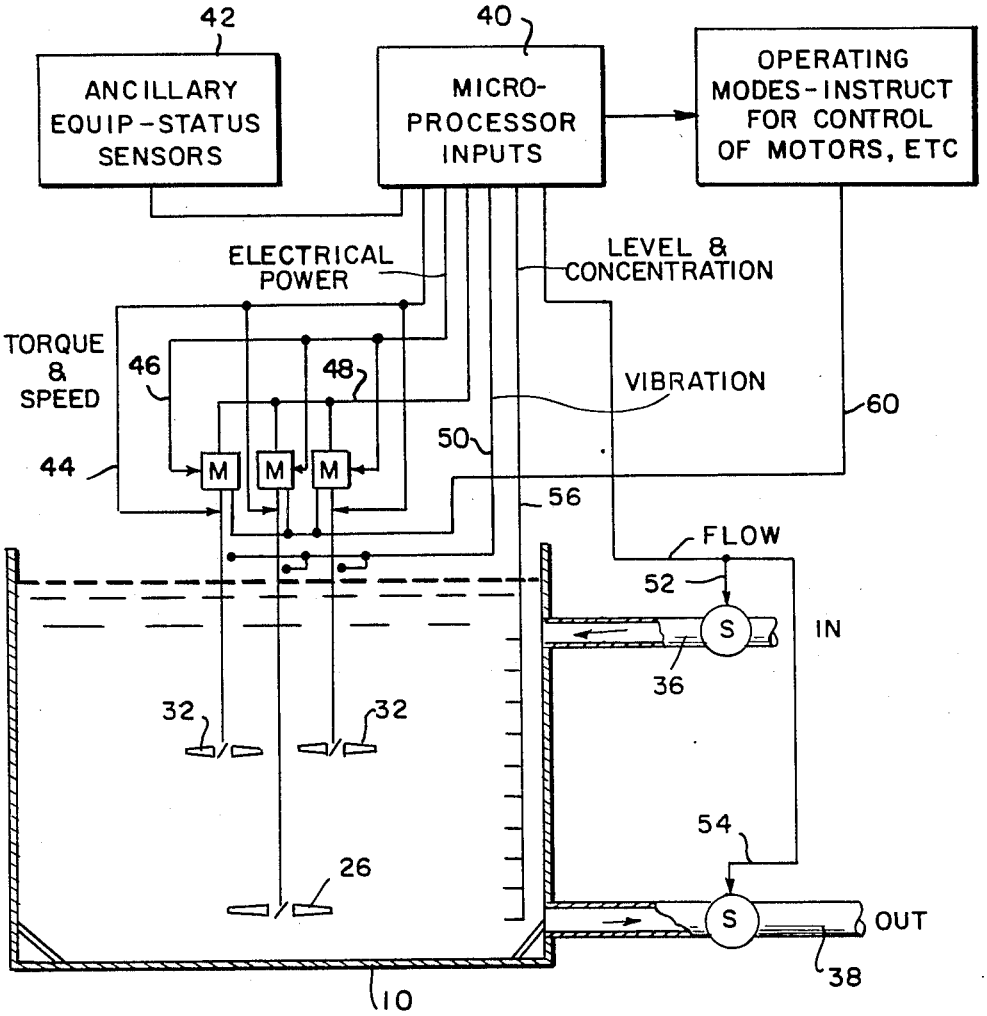
FIG. 7 is a block diagram of a control system incorporating the principles of the present invention.

A control system for the present invention is illustrated in FIG. 7 as having four impellers 32 at the upper level and a single center impeller 26 at the lower level within tank 10. An inlet pipe 36 and outlet pipe 38 are also shown. The control system includes a microprocessor 40 having inputs from (a) ancillary equipment and status sensors 42 upstream or downstream from the mixing tank, (b) The torque and speed of the individual motors via input 44, (c) the electrical power consumed by the motors via input 46, (d) the gear drive status of input 48, (e) the vibration of the drive shafts from input 50, (f) input flow sensor 52 on inlet 36, (g) outlet flow sensor 54 an outlet 38 and (h) level and concentration sensors 56. The output of the microprocessor is on line 60 to control the motors 20 and 28 as well as the inlet and outlet valves not shown.

The ancillary equipment and status sensors 42 may include, for example, sensors monitoring the valve position on the inlet 36 and outlet 38 as well as their pumps for various operations. This could be used as an advanced warning that the system will be filled or is about to be emptied. These indicators would then be consistent with the liquid level sensors as the tank is filled or emptied. Also, a failure of a pump or valve to operate could be monitored and the discrepancy noted.

As described above, the control system during the filling would maintain the impeller motors off until the fluid level sensor determines that there is sufficient fluid to activate the lower impeller 26. At such time, the impeller is turned on at low speed if desired and, as the level increases, the speed is increased. The actual speed can be confirmed by the speed sensors 44 on the shaft. As the level further increases, other mixers are turned on in proper sequence and set to the appropriate speed. The sensors reading of torque 44, power 46 and vibration 50 are compared with anticipated values. Any discrepancies may be noted to the operator. Gear drive operation is also continuously monitored by 48 and changes in operating forms can be measured and preventive maintainance scheduled. A sudden change or measurement outside prescribed gear drive operating ranges could shut down the unit and turn on alarm requiring immediate operator response.

Sensors 52 on the inlet could be used to monitor the solids added. Similar sensors 54 on the outlet would monitor the solids pumped out. The difference is the total solids in the mixing vessel 10 at any time. Concentrations sensors 56 at various locations within the vessel would indicate that the solid concentration throughout the tank. The degree to which the solid concentration varies is a direct indicator of the degree of mixing. This could be compared to system operating modes and form the basis for changing the mixer speed or shutting mixers on and off.

If there is a power failure or some event requiring all the mixers to be turned off, particulate matter would settle in the tank. The lower mixer would be totally surrounded by the compact solids. If this mixer were started at this condition, substantial mechanical failure would likely occur. The control system would review the status of the sensors when power is restored. The fluid level and solid concentration sensors would indicate the magnitude of the problem. The highest mixer in the vessel would be started first and is designed to operate above the settled solid bed. The jets from the mixer would progressively suspend the solids in the settled bed. As the bed height is lowered as determined by the concentration sensors, additional mixers would be activated. Once the start-up is completed, the unit would be returned to the long term storage or uniform mix mode.

Although the present invention has been described showing clusters of two mixers at various levels about a center mixer, the number of mixers per level or clustered may be increased. Preferably even numbers of mixers per cluster are provided. This allows the ability to shut down even number of mixers within a given cluster and not substantially effect the ability to produce a single flow field. Also, if a single mixer or impeller in a cluster should fail, another mixer may be shut down so that the remaining mixers provide a symmetry about the center single mixer. An odd number of mixers per cluster will be provided and is well within the anticipated invention.

It is evident from the detailed description of the drawings that the objects of the invention are attained in that a mixing system is provided which produces a single flow pattern. Although the present invention has been described and illustrated in detail, it is to be clearly understood that the same is by way of illustration and example only and is not to be taken by way of limitation. The spirit and scope of the present invention are to be limited only by the terms of the appended claims.

What is claimed is:

1. A mixer for fluids comprising:

a vessel having a fluid therein;

a first mixing means having a first impeller of a first diameter in a first plane in said vessel and having a vertical axis of rotation;

a plurality of second mixing means, each having a second impeller of a second diameter smaller than said first diameter, in a second plane in said vessel, and having a vertical axis of rotation spaced radially from said vertical axis of said first mixing means; and a plurality of drive means connected to said first and second mixing means for individually and independently rotating said first and second impellers to combine their flow patterns to produce single flow pattern in said fluid in said vessel.

2. A mixer according to claim 1 wherein said plurality of second mixing means have vertical axes of rotation positioned equally distant from and symmetrical about said first mixing means vertical axis of rotation.

3. A mixer according to claim 2 wherein said plurality of second mixing means are an even number.

4. A mixer according to claim 1 wherein said second plane is vertical displaced from said first plane.

5. A mixer according to claim 1 wherein said first plane is adjacent the bottom of said vessel and said second plane is adjacent the top of said vessel.

6. A mixer according to claim 1 wherein said second plane is adjacent the bottom of said vessel and said first plane is adjacent the top of said vessel.

7. A mixer according to claim 1 wherein said first and second plane are substantially the same plane and said first impeller is driven to rotate in an opposite direction than said second impellers.

8. A mixer according to claim 1 wherein said plurality of drive means includes a plurality of fixed speed motor, one for each impeller.

9. A mixer according claim 1 wherein said second impellers are located at least 0.5 $D_2$ from the top of said liquid where $D_2$ is said second diameter.

10. A mixer according to claim 1 wherein said plurality of second impellers are spaced vertically from said first impeller in a range of 0.5 $D_1$ to 2.0 $D_1$ wherein $D_1$ is said first diameter.

11. A mixer according to claim 1 wherein said vessel has a ratio of maximum fluid level to vessel diameter in the range of 0.4 to 2.0.

12. A mixer according to claim 1 wherein said first diameter is in the range of 0.1 T to 0.5 T where T is the diameter of said vessel.

13. A mixer according to claim 1 wherein said first impeller is located in a range of 0.25 $D_1$ to 2.0 $D_1$ from the bottom of the vessel where $D_1$ is said first diameter.

14. A mixer according to claim 1 including a plurality of third mixing means each having a third impeller positioned vertically between said first and second impellers in a third plane and a vertical axis of rotation spaced from said vertical axis of rotation of said first and second mixing means; wherein said drive means is connected to said third mixing mixing means for rotating said third impellers at a speed to produce a single flow pattern in said fluid in said vessel in combination with said first and second impellers.

15. A mixer according to claim 14 wherein said vessel has a ratio of maximum fluid level to vessel diameter greater than 2.

16. A mixer according to claim 1 wherein the side and bottom of said tank met at the interior of said tank at an angle greater than 90°.

17. A mixer according to claim 1 wherein each of said impellers have a predominately axial flow field exiting said impellers.

18. A mixer according to claim 1 wherein each of said impellers have a converging flow field exiting said impellers.

19. A mixer according to claim 1 wherein the second impellers have a different hand than said first impeller and are rotated in the opposite direction from said first impeller to pump in the same direction.

20. A mixer for a liquid or a liquid suspension medium comprising:

a vessel having a liquid therein;

a first mixing means having a first impeller of a first diameter in a first plane in said vessel and having a vertical axis of rotation;

a plurality of second mixing means, each having a second impeller of a second diameter smaller than said first diameter, in a second plane vertically displaced in said vessel and having a vertical axis of rotation spaced radially from said vertical axis of said first mixing means;

a plurality of drive means connected to each of said impellers for individually and independently rotating said first and second impellers at speeds to combine their flow patterns to produce a single flow pattern in said fluid in said vessel; and control means connected to said drive means for individually activating and deactivating said drive means for varying the degree of mixing while maintaining said single flow pattern.

21. A mixer according to claim 20 wherein said plurality of second mixing means have vertical axes of rotation positioned equally distant from and symmetrical about said first mixing means vertical axis of rotation.

22. A mixer according to claim 20 including a plurality of third mixing means, each having a third impeller in a third plane positioned vertically between said first and second planes and a vertical axis of rotation spaced from said vertical axis of rotation of said first and second mixing means; a plurality of drive means connected to said third mixing means for rotating said third impellers at a speed to produce a single flow pattern in said liquid in said vessel in combination with said first and second impellers.

23. A mixer according to claim 20 wherein each of said impellers have a predominately axial flow field exiting said impellers.

24. A mixer according to claim 20 wherein each of said impellers have a converging flow field exiting said impellers.

25. A mixer according to claim 20 wherein said drive means are fixed speed motors.

26. A mixer according to claim 20 wherein the side and bottom of said tank met at the interior of said tank at an angle greater than 90°.

27. A mixer according to claim 20 wherein the second impellers have a different hand than said first impeller and are rotated in the opposite direction from the first impeller to pump in the same direction.

* * * * *